United States Patent [19]

Rothweiler et al.

[11] Patent Number: 4,826,340

[45] Date of Patent: May 2, 1989

[54] HAND BRUSH

[76] Inventors: Emil Rothweiler, Im Etzental 8, 7450 Hechingen, Fed. Rep. of Germany; Gerald Siegel, 3425 W. Osborn Rd., Phoenix, Ariz. 85017

[21] Appl. No.: 139,848

[22] Filed: Dec. 29, 1987

[30] Foreign Application Priority Data

Jan. 3, 1987 [DE] Fed. Rep. of Germany ..... 3700113

[51] Int. Cl.[4] ..... A46B 11/00

[52] U.S. Cl. ..... 401/279; 401/205; 401/207; 401/270; 401/288

[58] Field of Search ..... 401/278, 279, 263, 205, 401/270, 207, 265, 288; 222/191, 510

[56] References Cited

U.S. PATENT DOCUMENTS

| | | | |
|---|---|---|---|
| 673,918 | 5/1901 | Murray | 401/205 |
| 838,241 | 12/1906 | Connors | 401/279 |
| 1,099,209 | 6/1914 | Segal et al. | 401/279 |
| 2,095,423 | 10/1937 | Tilley | 401/207 |
| 2,509,568 | 5/1950 | Lachapelle | 401/206 X |
| 2,521,882 | 9/1950 | Swift et al. | 222/510 X |
| 2,920,333 | 1/1960 | Montague et al. | 401/265 X |
| 4,236,840 | 12/1980 | Kennedy | 401/270 X |

*Primary Examiner*—Steven A. Bratlie
*Attorney, Agent, or Firm*—Michael J. Striker

[57] ABSTRACT

A hand brush having a housing and a handle which jointly enclose a space for storing a cleaning liquid applied thereinto through a filing opening closed with a flap. A valve which closes a liquid discharge opening is formed on a spring yoke connected to a hand-operated actuating slide provided on the handle. The yoke exerts on the valve a force in the closing direction of the discharge opening.

4 Claims, 4 Drawing Sheets

HAND BRUSH

BACKGROUND OF THE INVENTION

The present invention relates to a hand brush with a gripping handle, and also with housing which is hollow and serves as a storage for containing a cleaning liquid therein Hand brushes of the type under discussion also have a brush body having bristles or a foam piece thereon and provided with a discharge opening for the cleaning liquid contianed in the housing. Such a discharge opening is closable by a valve. Conventional hand brushes of the foregoing type have been in use and can be of various shapes and serve various purposes.

SUMMARY OF THE INVENTION

It is an object of the present invention to provide an improved hand brush.

It is another object of the invention to provide a hand brush which is reliable in operation and inexpensive in manufacture.

These and other objects of the invention are attained by a hand brush, comprising a handle; a housing; a brush body supported on said housing, said handle and said housing forming a storage space for a cleaning liquid; means defining a discharge opening for said liquid, which opens into said brush body; a valve member closing said discharge opening and operated by hand to open the same; a spring yoke anchored in said housing and connected to said valve member to exert pressure thereon in a direction of closing of said valve member; hand operated actuating means provided on said handle for actuating said valve member; and connecting means interconnected between said yoke and said actuating means.

The spring yoke may be clamped in which housing at two opposite ends thereof.

Said spring yoke, said valve member, said connecting means and said actuating means may be a prefabricated and preassembled one-piece unit.

By providing a spring or resilient yoke acting on the valve member the latter is pressed against the valve seat whereby it is ensured that no cleaning liquid can flow from the discharge opening of the brush. The formlocking coupling of the actuating means with the yoke and valve member additionally ensures that in the opening position of the actuating means the valve member is lifted off its valve seat and releases the discharge opening. The valve member can adhere to its valve seat, but will be easily released from the valve seat by the force exerted upon the actuation of the acutating means by hand. The discharge opening remains open as long as the force is exerted on the actuating means. As soon as the handoperated acutating means is released the prestressed spring yoke not only will move the valve member back towards the valve seat but also the actuating means itself will return to its non-operative position.

The handle with said housing may be jointly formed of at least two mirror-inverted similar halves, said connecting means being formed as a flexible bar, said housing including guide grooves, said actuating means being formed as a slide guided in said grooves of which one is provided in one half of said housing and another is provided in another half of said housing.

The brush may further include a bottom connected to said housing and formed with said discharge opening, said brush body having a through passage which is in alignment with said discharge opening.

The housing may be provided at an upper side thereof with an inlet filling opening; the brush further including at least one pivotable flap for closing said filling opening, said two halves of the housing supporting a pivot axis for pivoting said flap.

The pre-fabricated closing and opening mechanism and the flap for the filling opening are inserted in the housing also, upon assembling two housing halves together in a formlocking fashion.

The brush body may be interchangeable and be of various types.

The brush body may carry a plurality of bristles thereon or be made of foam.

The brush body may include a threaded ring connected to the housing, a brush element of foam or steel wool, and a supporting plate inserted in said ring and carrying at an external side thereof a plurality of hooks for holding said brush element.

The supporting plate may have a central discharge through opening.

The bottom of the brush may be formed by said brush body tightly applied to said housing.

The novel features which are considered as characteristic for the invention are set forth in particualr in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
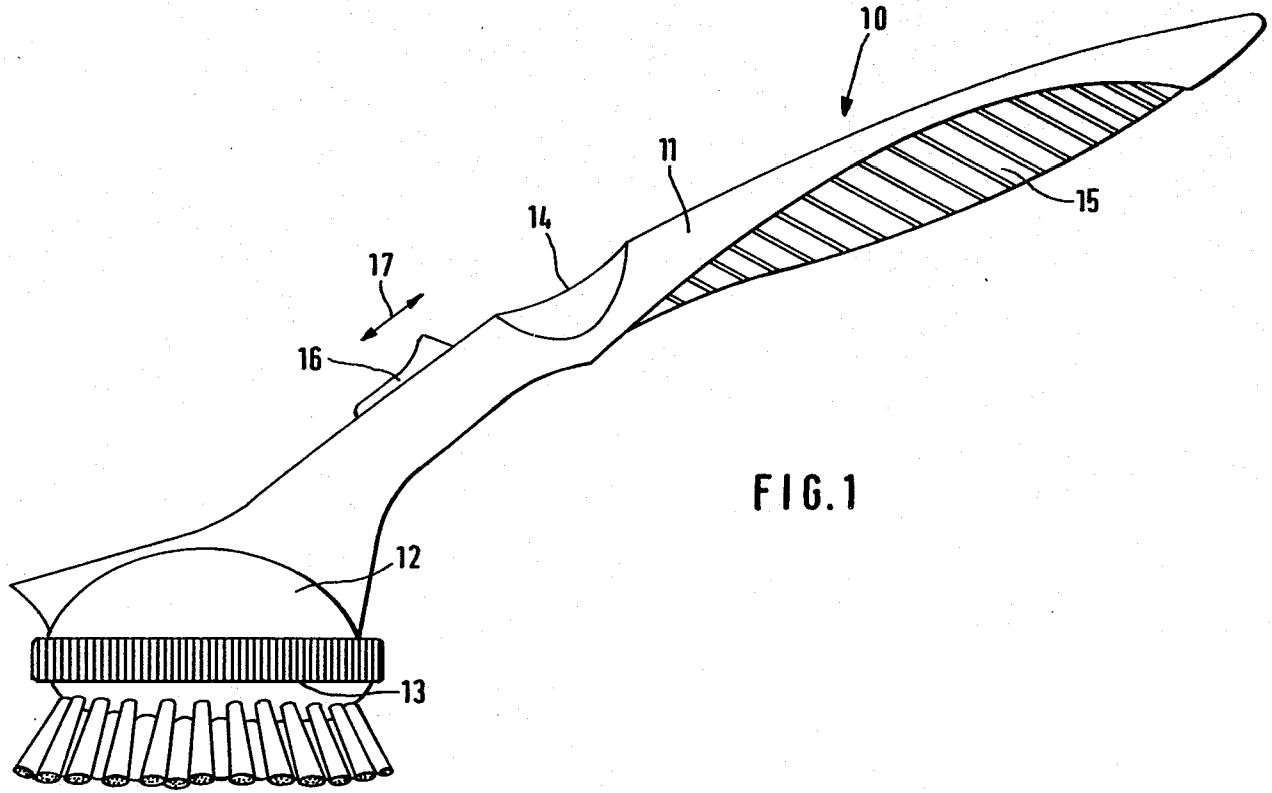
FIG. 1 is a side view of the hand brush according to the invention.

Referring now to the drawings in detail and firstly to FIG. 1 thereof, it will be seen that the hand brush according to the invention and designated at 10 in the drawing comprises a brush handle 11 connected to a housing 12 on which a substantially round brush body 13 is mounted. The brush body 13 can be of various types as will be explained below and is interchangeable.

The handle 11 has an upper gripping depression 14 for a thumb and a lateral corrugated gripping depression 15 for remaining fingers of the hand. A slide 16 which is slidable in the direction of elongation of the brush by the thumb is positioned on the upper face of the brush handle before depression 14. The directions of displacement of slide 16 are indicated in FIG. 1 by double arrow 17.

Figures 2, 3:
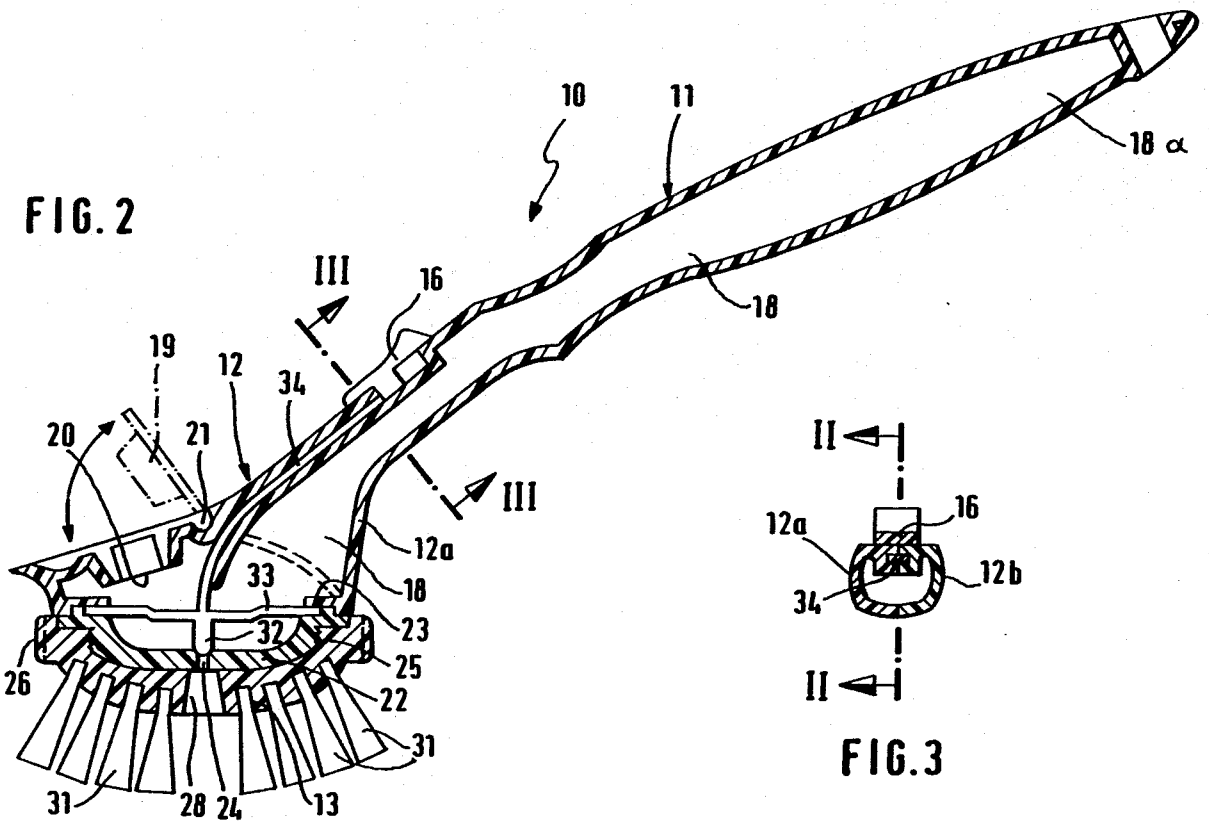
FIG. 2 is a sectional view taken along line II—II of FIG. 3.
FIG. 3 is a sectional view taken along line III—III of FIG. 2.

Referring now to FIGS. 2 and 3 it will be seen that handle 11 which merges into housing 12 is hollow and encloses jointly with housing 12 a passage or channel 18. A through opening 18*a* is provided at the end of handle 11 for hanging the brush on a hook. Housing 12 with handle 11 is assembled of two similar mirror-inverted halves 12*a* and 12*b*. FIG. 2 shows also the connection surface of the housing half 12*a*. Housing halves 12*a* and 12*b* are made of synthetic plastic material by injection molding, which halves are connected to each other by welding. The space or channel 18 serves as a storage for a cleaning liquid which is applied through an inlet filling opening 20 which is closable by a flap or cover 19 provided on the upper side of housing 12. The flap 19 is provided with axial pins 21 which form pivot axes and of which one is engaged in a non-shown bearing opening of housing half 12*a* and another is engaged in the bearing opening of the housing half 12*b*. The pivoting motion of flap 19 is indicated in FIG. 2 by arrow. Housing 12 has a downwardly curved round-surface bottom wall 22 which is connected by glue with a flange ring 23. A liquid outlet opening 24 is formed in the center of the bottom wall 22. The bottom wall 22 is provided with an external thread 25 on which an internal thread of the brush body 13 is screwed.

Figure 4A:
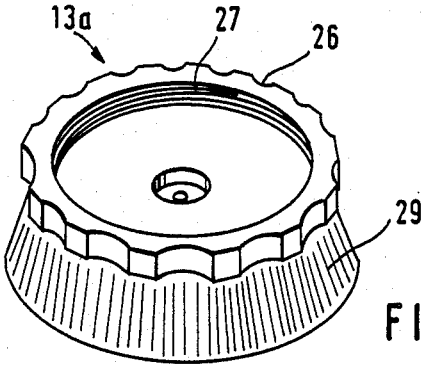
FIG. 4*a* is a perspective view of the brush body of a first embodiment.
Figure 4B:
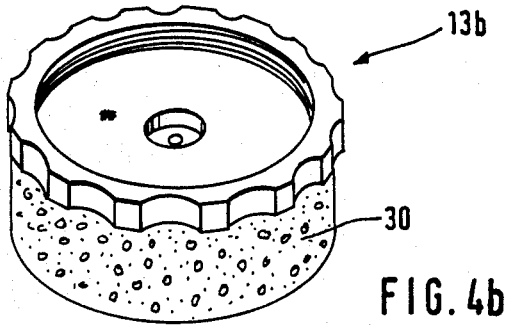
FIG. 4*b* is a perspective view of the brush body of a second embodiment.
Figure 4C:
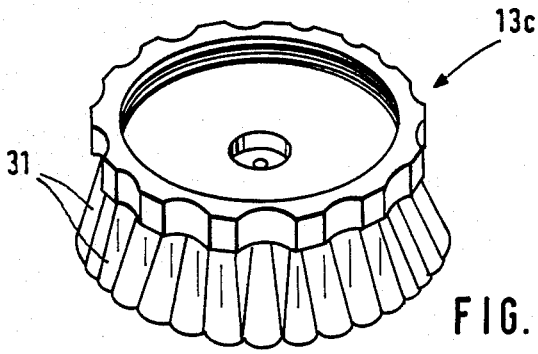
FIG. 4*c* is a perspective view of the brush body of a third embodiment.

FIGS. 4*a*, 4*b* and 4*c* show three different types of brush bodies 13*a*, 13*b* and 13*c*, respectively. Each brush body has a gripping rim 26 at the level of the internal thread 27 and a central through passage 28 (FIG. 2) which is aligned with outlet opening 24 of the bottom wall 22. Brush body 13*a* in FIG. 4*a* is tightly connected with relatively thin bristles 29. Brush body 13*b* in FIG. 4*b* has a cylindrical foam brushing member 30, and brush body 13*c* in FIG. 4*c* has individual bristle tufts 31.

As shown in FIG. 2, liquid outlet opening 24 in the bottom wall 22 is closed by means of a valve member 32 which is formed on a spring or resilient yoke 33. At the side of the yoke 33 opposite to the valve member 33, is formed a flexible connection bar 34 which leads to the slide 16. The resilient yoke 33 with the valve member 32, connection bar 34 and slide 16 can be formed as a one-piece unit of elastic plastic material. The resilient yoke 33 which is clamped at two opposite ends thereof between the bottom wall 22 and the flange ring 23 of the housing 12 can be made of spring steel. This yoke is curved and clamped in housing 12 so that it exerts pressure on the valve member 12 in the closing direction thereof. The resilient connection bar 34 is guided in a guiding groove of housing 12 is partially formed in housing half 12*a* and partially in the housing half 12*b* as shown in FIG. 3. Slide 16 is positioned at these two halves similarly to the connection bar 34.

With the hand brush without interchangeable brush bodies a valve seat for the valve members can be formed directly on the through passage 28 of the brush body which at the same time would form the brush bottom.

As shown further in FIG. 2 the valve member 32 is in the drawing in its closing position in which it is pressed by pre-stressing of resilient yoke 33 against the liquid outlet opening 24 and closes this opening. If the cleaning liquid should flow from the storage space 18 into the through passage 28 of the brush body the slide 16 is pulled with the thumb in the upward direction of handle 11 whereby spring yoke 33 with the valve member 32 will be lifted from the liquid discharge opening 24. As soon as slide 16 is released from the thumb it will be moved back by the force of yoke 33 to its initial position shown in FIG. 2, and the valve member 32 will again close the discharge opening 24.

Figure 5:
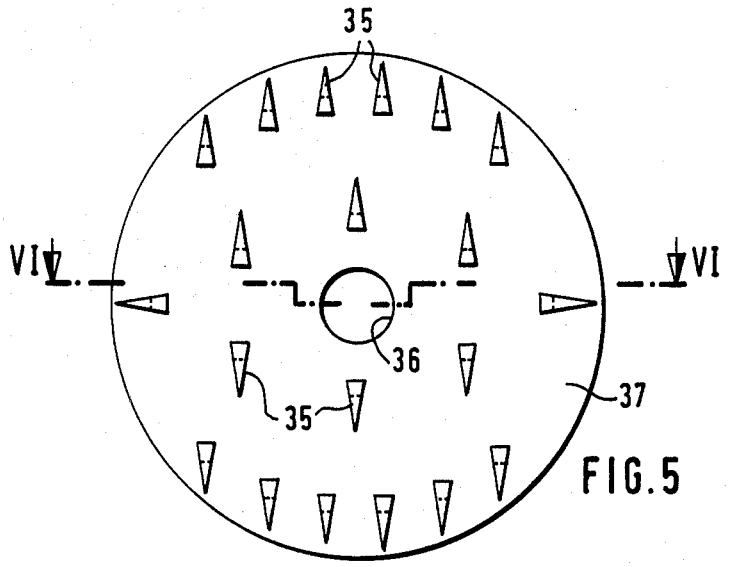
FIG. 5 is a top plan view of the external side of the brush body.
Figure 6:
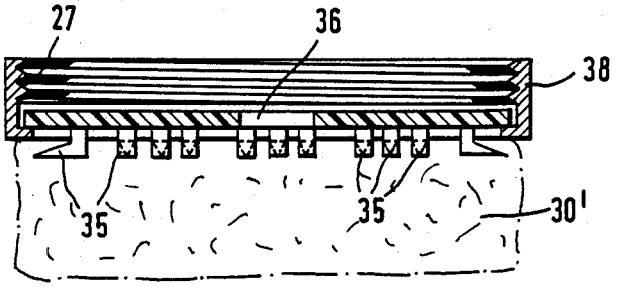
FIG. 6 is a sectional view taken on line VI—VI of FIG. 5.

FIG. 5 shows the plan view of the external side of a supporting plate 37 which is inserted in a threaded ring 38 as shown in FIG. 6. Ring 38 has an internal thread 27 for securing to the external thread 25 of the bottom wall of the brush body 10. At the external side of supporting plate 37 which is provided with a central through opening 36, are arranged a plurality of acute hooks 35 bent to the surface of the supporting plate 37 at different angles. These hooks can be made of one piece with the supporting plate of synthetic plastic material. A brush body, for example of foam as shown in FIG. 4*b* can be simply connected to these hooks so that the brush body will be pressed against the supporting plate 37 whereby hooks 35 will penetrate foam material of the brush body 30'. Instead of the foam brush body a piece of steel wool can be anchored to the brush housing 11, 12 by means of hooks 35.

It will be understood that each of the elements described above, or two or more together, may also find a useful application in other types of hand brushes differing from the types described above.

While the invention has been illustrated and described as embodied in a hand brush, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A hand brush, comprising, a handle; a housing; a brush body releasably supported on said housing, said handle and said housing forming a storage space for a cleaning liquid; means defining a discharge opening for said liquid which opens in said brush body; a valve member provided between said brush body and said storage space for closing and opening said discharge opening; a spring yoke member connected with said valve member to exert a pressure thereon in direction of closing of said valve member; a hand-operated actuating member for actuating said valve member; a connecting member which connects said yoke member with said actuating member, said housing with said handle being jointly formed of two mirror-inverted similar halves of a synthetic plastic material which are connected with one another over a connection surface, said halves being provided with grooves which extend from said connection surface and formed for receiving said members, said actuating member together with said valve member and said spring yoke member and said connecting member being formed as a one-piece unit which is insertable in respective ones of said grooves prior to connection of said halves over said connection surface.

2. A hand brush as defined in claim 1; and further comprising means forming a filling opening which has one opening half provided in one of said halves and another opening half provided in the other of said halves; and a pivotable flap provided for closing said filling opening and having axial supporting pins, said halves being provided with further grooves extending from said connection surface and receiving said flap with said pins.

3. A hand brush as defined in claim 1, wherein said brush body has an inner thread, said housing having an outer thread on which said inner thread of said brush body is screwable, said outer thread of said housing having one half thread provided on one of said halves and another half provided on the other of said halves.

4. A hand brush as defined in claim 3, wherein said brush body includes a threaded part provided with said inner thread and carrying a plane supporting plate having a plurality of symmetrically arranged hooks which are bent in different directions and provided with tips for anchoring a foam body exclusively by said hooks.

* * * * *